United States Patent [19]

Aluotto

[11] Patent Number: 4,893,542

[45] Date of Patent: Jan. 16, 1990

[54] SHELL LUBRICATOR

[76] Inventor: Peter A. Aluotto, 1668 Hendrickson St., Brooklyn, N.Y. 11234

[21] Appl. No.: 282,484

[22] Filed: Dec. 9, 1988

[51] Int. Cl.[4] ..... F42B 31/02

[52] U.S. Cl. ..... 86/19; 102/435; 184/101; 184/102

[58] Field of Search ..... 184/101, 102, 109; 86/19; 102/435

[56] References Cited

U.S. PATENT DOCUMENTS

| | | | |
|---|---|---|---|
| 242,052 | 5/1881 | Salisbury | 86/19 |
| 1,322,271 | 11/1919 | Thompson | 86/19 |
| 2,547,548 | 4/1951 | Turner | 86/19 |
| 2,849,980 | 9/1958 | Collins et al. | 86/19 |

*Primary Examiner*—Henry A. Bennet

*Assistant Examiner*—Denise L. Ferensic

*Attorney, Agent, or Firm*—Kane, Dalsimer, Sullivan, Kurucz, Levy, Eisele & Richard

[57] ABSTRACT

This disclosure shows a device designed to facilitate the lubrication of the external surface of a shell casing prior to its being forcibly incserted into a constricting die, in order to be reconditioned for eventual reuse. The device, or shell lubricator, includes a rotatable rigid, cylindrical roller which faces an arcuate, rigid plate. Both of these are faced with a resilient, absorbent material, such as felt, which can hold a lubricating material, to a thickness such that a gap is left between them for the insertion of a shell casing. The shell casings are inserted one-by-one into the shell lubricator, whose rotating cylindrical roller drives them through the gap where they acquire the necessary coating of lubricating material.

4 Claims, 3 Drawing Sheets

SHELL LUBRICATOR

BACKGROUND OF THE INVENTION

1. Field of the Invention

The present invention relates to the reconditioning of the metal shell casings of used rifle or pistol ammunition for eventual re-use. More specifically, it provides a device designed to facilitate the lubrication of the exterior of a shell casing which makes it possible to force the shell casing into a constricting die.

2. Description of the Prior Art

The present invention, a so-called shell lubricator, is a device designed to lubricate the external surface of the metal shell casing of used rifle or pistol ammunition, which is frequently a necessary first step toward reconditioning them for re-use.

Rifle and pistol enthusiasts, who perhaps shoot as a hobby or sport, and hunters and other outdoorsmen, are all well-acquainted with the desirability, often a necessity, of reconditioning the shell casings of spent ammunition for eventual re-use. This is primarily motivated by the high cost of ammunition. Part of this high cost, in turn, can be accounted for by the high cost of the metal used to form the shell casing. Frequently, brass is used for this purpose. Brass has become quite expensive in recent years.

Experienced shooters can reduce their ammunition costs, and at the same time increase their opportunities for participating in their chosen hobby or sport by repacking the spent shell casings with powder and a bullet for re-use. Unfortunately, this procedure is complicated by the effect the previous use of the shell has on the structure of the shell casing.

When the rifle or pistol is fired, the gunpowder within the shell casing explodes, and the expanding gases produced by the explosion drive the bullet forward out the barrel. The metal shell casing left behind can then be ejected from the rifle or pistol. The heat and forces of expansion have the tendency to stretch the shell casing from its original, exact size. If repacked with powder and a bullet in this condition, it could well turn out to be impossible to reload it into a firearm because of its possible departure from exact measurement tolerances. A distortion in size of only a few thousandths of an inch can render a shell casing unsuitable for re-use.

Such distortion can be corrected by using a constricting die of the exact diameter required for the particular variety of ammunition. These dies are formed from an extremely hard material, such as arborundum.

In some ammunition, the shell casings are essentially cylindrical in shape, and have an open end and a closed end. It is a relatively easy matter to re-size shell casing of this sort by forcing them, open end first, into dies of appropriate diameter.

In other ammunition, the shell casings are of a more complicated geometry. One could describe this geometry as being vaguely bottle-shaped, due to its having a cylindrical portion of one diameter which narrows at a certain point to a cylindrical portion of smaller diameter. In this case, the open end is on the portion of smaller diameter.

Reconditioning dies for constricting and re-sizing shell casings of this type are readily available. However, it is much more difficult to force this kind of shell casing into the appropriate die. Indeed, it is virtually impossible to do so without first lubricating the exterior surface of the shell casing with grease or oil to permit its complete entry into the die.

According to the prior art, this lubrication is accomplished using a resilient, absorbent pad, containing grease or oil, and having an appearance similar to that of an inked stamp pad. The shell casings to be reconditioned are placed on the grease pad and rolled back and forth with a hand motion to coat the outer surfaces with the lubricant.

This procedure has the disadvantage of being extremely slow and time-consuming. To make matters worse, the hand of the user gets completely coated with grease or oil as well as the shell casing and, in time, the skin of the hand becomes chaffed and irritated by this repetitive action.

With the present invention, rifle and pistol enthusiasts are provided with an alternate, and improved, device for lubricating the external surfaces of spent shell casings.

SUMMARY OF THE INVENTION

The shell lubricator of the present invention removes the necessity of rolling the shell casings on a lubricating pad by hand. Its essential components are a rotatable rigid cylindrical roller and an arcuate, rigid plate, whose concave side faces the cylindrical roller. Both the cylindrical roller and the concave side of the arcuate, rigid plate are covered with a resilient, absorbent material, such as felt, capable of absorbing a lubricating material. A gap is present between these covered surfaces so that shell casings can be inserted and carried through by the rotating motion of the rigid, cylindrical roller. In passing through the gap, the shell casings acquire an even and light coating of grease from the resilient, absorbent covering material.

DETAILED DESCRIPTION OF THE PREFERRED EMBODIMENT

Figure 1:
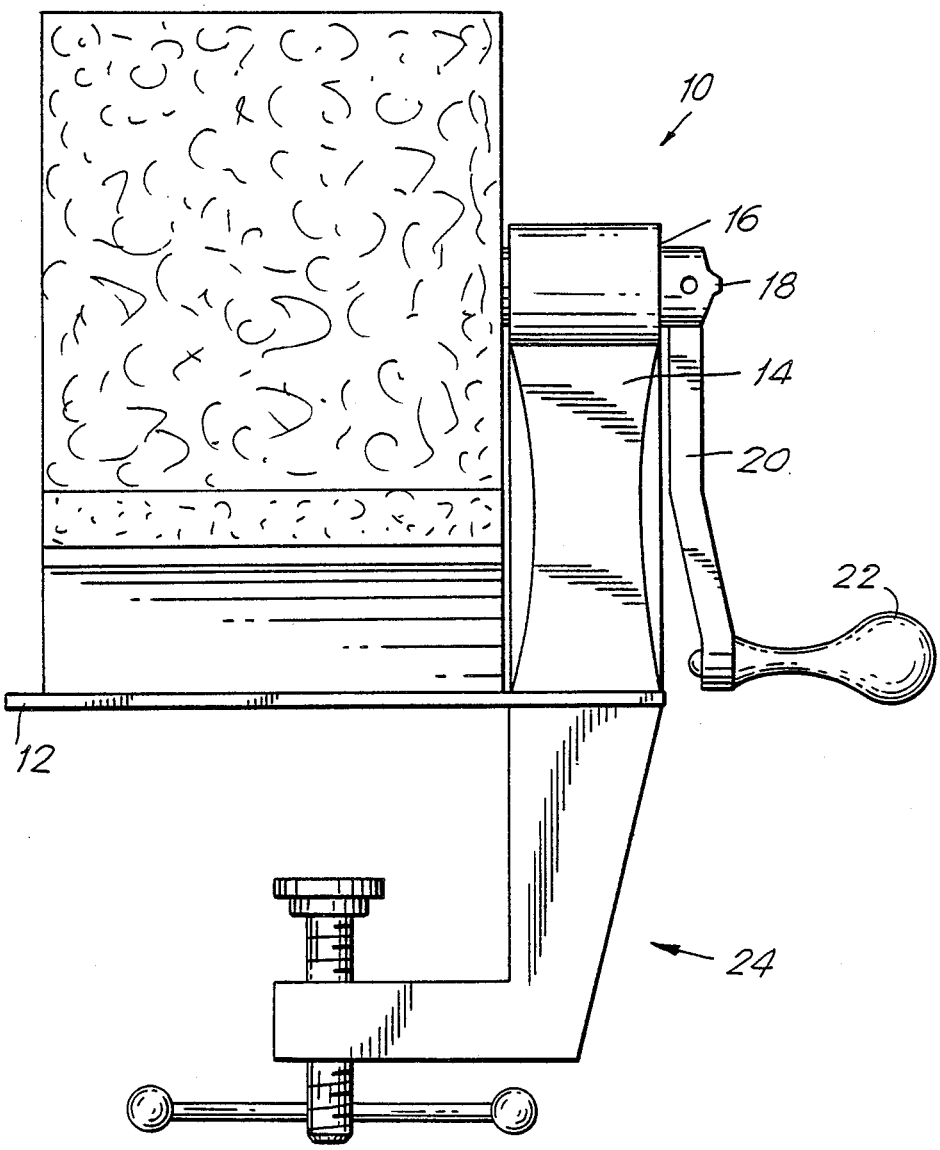
FIG. 1 is a side view of the shell lubricator of the present invention.

In FIG. 1 is shown a side view of the shell lubricator 10 of the present invention. It includes a horizontal support member 12 and a vertical support member 14.

The vertical support member 14 is provided with a bore 16, through which an axle 18 can extend and protrude therefrom. To the axle 18 is attached a crank 20 with a handle 22, which can be used to operate the shell lubricator 10 in a manner to be described in the discussion of FIG. 1 which follows below.

Figure 3:
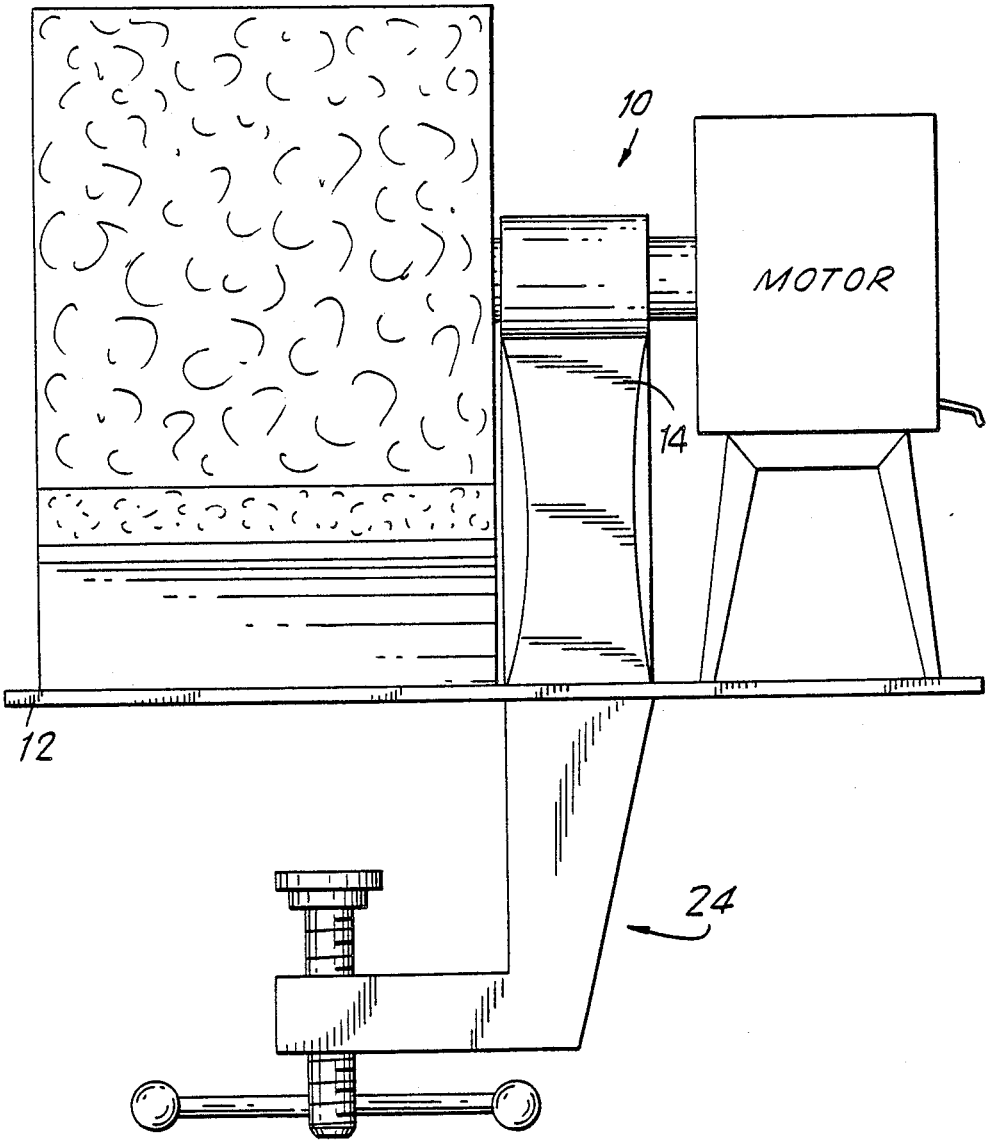
FIG. 3 is a side view of an alternate embodiment of the present invention.

In an alternate embodiment, the crank 20 can be replaced by a motor, as shown in FIG. 3, which can run the shell lubricator 10 leaving the operator with two free hands for feeding the shell casings to be lubricated into the device.

As also shown in FIG. 1, a clamp 24 can be provided to fixedly attach the shell lubricator 10 to a table or other work surface. Other means, however, can carry out this function as well, and fall within the scope of the appended claims.

With reference now to FIG. 2, one can again see the clamp 24 and horizontal support member 12. Mounted on the horizontal support member 12 is an arcuate, rigid plate 26. Both the arcuate, rigid plate 26 and the horizontal support member 12 can be fabricated from ⅛ inch steel plate, but other rigid materials will suffice as well.

Mounted above the arcuate, rigid plate 26 is a rigid, cylindrical roller 28, which is rotated by the crank 20 seen earlier in FIG. 1. The cylindrical roller 28 can be made of wood and have a diameter of 2½ inches, but other materials and diameters can be chosen.

The arcuate, rigid plate 26 and the rigid, cylindrical roller 28 are both covered with a resilient, absorbent material 30, such as felt, which can be impregnated with the lubricating grease or oil. Typically, the thickness of the resilient, absorbent material 30 is chosen to be approximately ½ inch, and should permit there to be a gap 32 between the two resilient, absorbent material 30 covered surfaces of approximately 3/16 inch. The applicant advises that a gap 32 of ¼ inch is sufficient to accommodate all sizes of shell casings.

Figure 2:
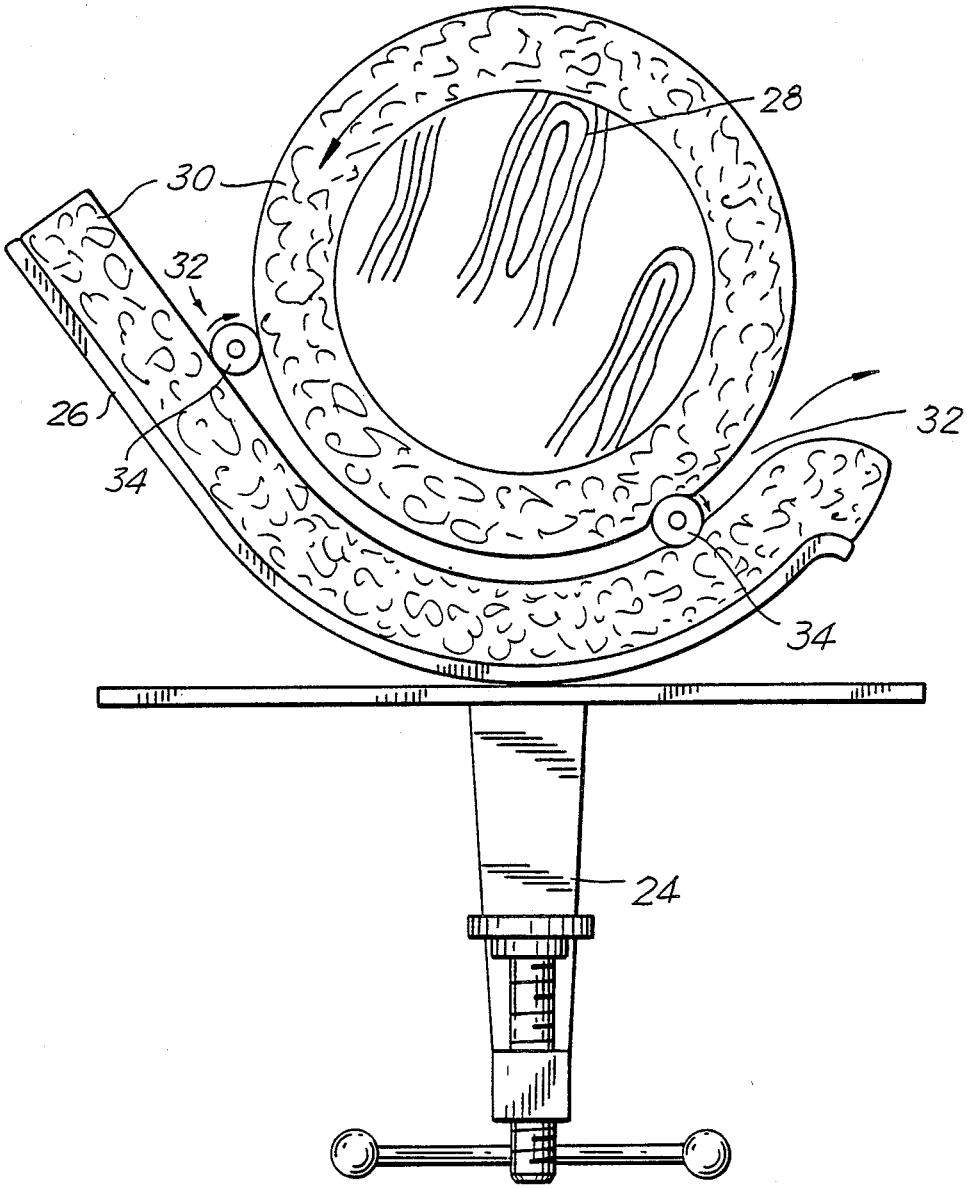
FIG. 2 is a front view of the shell lubricator.

In practice, the covered, rigid cylindrical roller 28 is rotated by means of the crank 20, or a motor. This is shown in FIG. 2 to proceed in the counter-clockwise sense. Shell casings 34 are fed one-by-one onto the gap 32, through which they are carried by the rotational motion of the rigid, cylindrical roller 28. As the shell casings 34 do so, they are rolled between the two resilient, absorbent materials 30 which provides them with the coating of lubricant needed for the later insertion into a die.

Modifications to the above would be obvious to one skilled in the art without departing from the scope of the appended claims.

What is claimed is:

1. A shell lubricator, for lubricating the external surface of a shell casing with grease or oil, comprising:

a vertical support member having an upper end and a lower end, said upper end being provided with a bore;

a horizontal support member serving as a base for said shell lubricator, said lower end of said vertical support member being rigidly attached to said horizontal support member;

means for fixedly and removably attaching said horizontal support member to a work surface;

an arcuate, rigid plate having a convex side and a concave side attached to said horizontal support member at a point adjacent to said vertical support member so that said concave side of said arcuate, rigid plate faces away from said horizontal support plate;

a first resilient, absorbent covering capable of holding a lubricating material attached to said concave side of said arcuate, rigid plate;

a rigid, cylindrical roller having two ends, a cylindrical side surface, and an axle protruding from one of said two ends, said axle designed to be passed through said bore in said vertical support member so that the rotation of said axle will cause the rotation of said rigid, cylindrical roller, said rigid, cylindrical roller facing said concave side of said arcuate, rigid plate;

a second resilient, absorbent covering attached to said cylindrical side surface of said rigid, cylindrical roller and being capable of holding a lubricating material, said second resilient, absorbent covering being of a thickness on said cylindrical side surface of said rigid, cylindrical roller that will leave a gap between said second resilient, absorbent covering and said first resilient, absorbent covering on said arcuate, rigid plate so that said rigid, cylindrical roller can freely rotate; and means for rotating said rigid, cylindrical roller.

2. A shell lubricator as claimed in claim 1 wherein said means for rotating said rigid, cylindrical roller comprises a crank attached to said axle protruding through said bore in said vertical support member.

3. A shell lubricator as claimed in claim 1 wherein said means for rotating said rigid, cylindrical roller comprises a motor drivingly attached to said axle protruding through said bore in said vertical support member.

4. A shell lubricator as claimed in claim 1 wherein said means for fixedly and removably attaching said horizontal support member to a work surface comprises a clamp.

* * * * *